United States Patent [19]

Ohlbach

[11] 4,293,070

[45] * Oct. 6, 1981

[54] FOR PROTECTING PRINTED CIRCUIT BOARDS AND OTHER ITEMS AGAINST THE RAVAGES OF A DISCHARGE OF STATIC ELECTRICITY

[76] Inventor: Ralph C. Ohlbach, 417 Green Park Ct., Deerfield, Ill. 60015

[ * ] Notice: The portion of the term of this patent subsequent to Jul. 10, 1996, has been disclaimed.

[21] Appl. No.: 58,786

[22] Filed: Jul. 19, 1979

Related U.S. Application Data

[63] Continuation-in-part of Ser. No. 25,336, Mar. 30, 1979, abandoned.

[51] Int. Cl.[3] ..... B65B 81/24; B65B 85/42

[52] U.S. Cl. ..... 206/328; 53/411; 53/472; 206/444

[58] Field of Search ..... 206/312, 328, 444, 533, 206/592, 811, 433, 392, 524; 361/212; 53/411, 472; 428/408; 229/42

[56] References Cited

U.S. PATENT DOCUMENTS

| | | | |
|---|---|---|---|
| 1,249,197 | 12/1917 | Rhodes | 229/42 |
| 1,268,347 | 6/1918 | Harr | 229/42 |
| 1,313,948 | 8/1919 | Maegly | 229/42 |
| 1,887,864 | 11/1932 | Stokes | 53/411 |
| 2,543,201 | 12/1950 | Hutter | 206/811 |
| 2,570,340 | 10/1951 | George | 229/42 X |
| 2,669,380 | 2/1954 | Grenier | 229/42 |
| 3,058,586 | 10/1962 | Touart | 53/411 |
| 3,190,442 | 6/1965 | Gauss | 206/524 |
| 3,516,596 | 6/1970 | Madden | 229/42 |
| 3,709,325 | 1/1973 | Gordon | 206/392 |
| 3,750,871 | 8/1973 | Cook | 206/433 X |
| 3,774,757 | 11/1973 | Harris et al. | 361/212 X |
| 3,958,022 | 5/1976 | Sands | 428/408 |
| 3,993,827 | 11/1976 | Dukert | 428/408 |
| 4,038,693 | 7/1977 | Huffine et al. | 206/444 |
| 4,084,210 | 4/1978 | Forrest | 361/212 |
| 4,160,503 | 7/1979 | Ohlzach | 206/328 |
| 4,211,324 | 7/1980 | Ohlzach | 53/411 |

OTHER PUBLICATIONS

Insulation/Circuits–Jan. 1977–pp. 25 & 26.

*Primary Examiner*—John Sipos
*Attorney, Agent, or Firm*—Kinzer, Plyer, Dorn & McEachran

[57] ABSTRACT

Shipping container and storage cartons for printed circuit boards, are composed entirely of paper board coated on inside surfaces with conductive carbon black particles to prevent an outside static electricity charge from passing through the container or carton.

14 Claims, 12 Drawing Figures

Fig. 1.
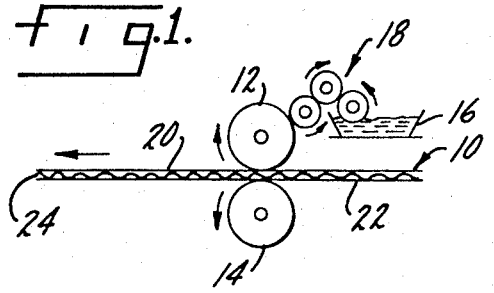
Fig. 2.
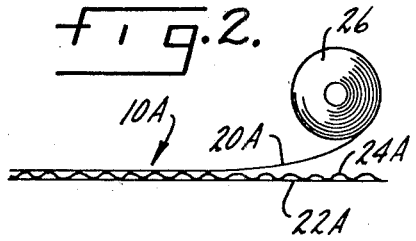
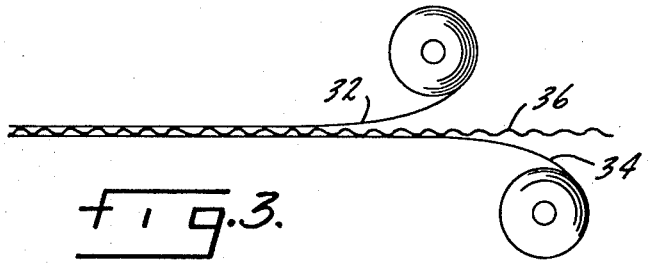
Fig. 3.
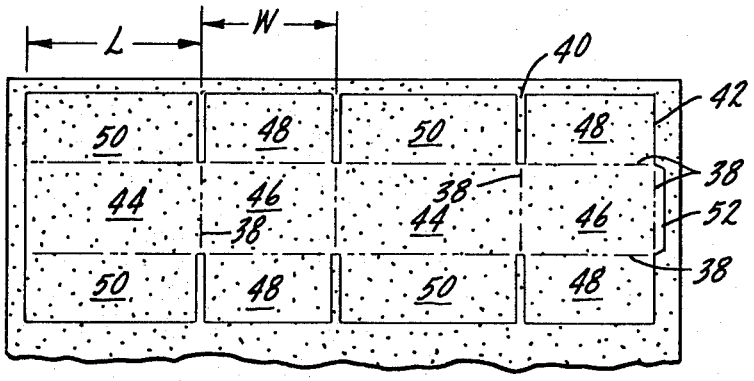
Fig. 4.
Fig. 5.
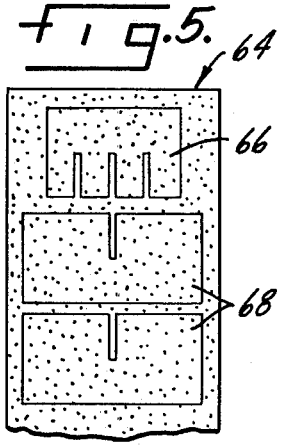
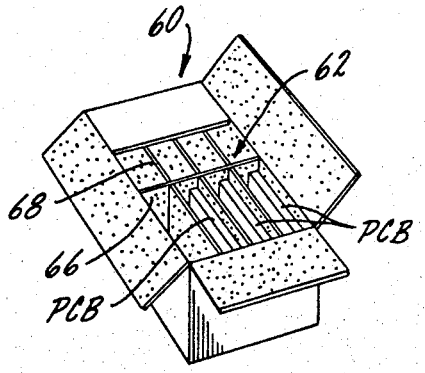
Fig. 6.
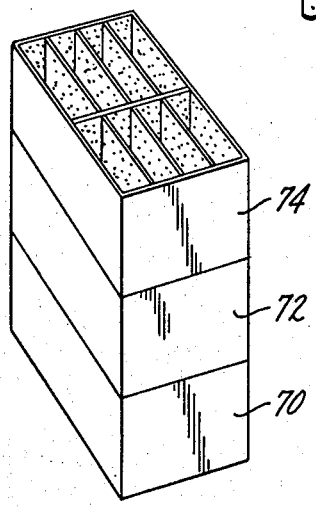
Fig. 7.
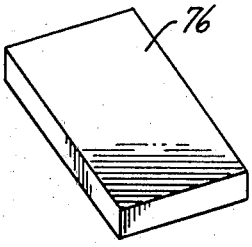
Fig. 8.

FOR PROTECTING PRINTED CIRCUIT BOARDS AND OTHER ITEMS AGAINST THE RAVAGES OF A DISCHARGE OF STATIC ELECTRICITY

REFERENCE TO RELATED APPLICATION

This application is a continuation-in-part application Ser. No. 025,336, filed Mar. 30, 1979 now abandoned.

This invention relates to the protection of goods which can be ruined by a discharge of static electricity.

Static electricity has become a large problem for the electronics industry. With the advent of micro circuitry—and the use of integrated circuits incorporating metal oxide semiconductors, complementary metal oxide simiconductors and field effect transistor silicon chips, packaging for shipping, storing and transferring printed circuit (PC) boards within production and service lines must offer protection against static electricity. Static electricity is originated in different ways but most commonly by movement of the person about the floor so that a charge is transferred from the person's hand to the circuitry, resulting in ciritical damage to one or more of the chips which most of the time is not even known.

To date there is only a carbon impregnated plastic bag to protect the printed circuit boards from being damaged by large charges of static electricity. There is semi-clear polyethylene (bag or wrapping material) and also a "pink bubble" wrap material but each of these materials has proven to be only surface resistant up to twenty-five hundred volts per square inch, whereas the static charge can be much higher.

The use of flimsy plastic bags containing conductive carbon has proven to be costly and inadequate for handling, storing, inventory control and shipping of PC boards. Also the printed circuit board, during assembly at the manufacturing plant, has to be removed from the bag, some chips added at one station, reinserted in the bag, the bag slid to the next work station where more chips are added, and so on. A similar procedure is involved when the repairman services customer equipment. His service kit may contain a collection of printed circuit boards totalling a worth of thousands of dollars. He locates the defective PC board, removes a new PC board (bagged) from the kit, replaces the defective PC board, inserts the defective board in the bag, returns to his service point, packages the defective board in a shipping-carton and returns it to the manufacturer. The shipping carton is usually thrown away and this is also true of the carton used to return the replacement board to the manufacturer. During this procedure, as in the assembly process, a static charge may be inadvertently transferred to the board resulting in further damage to the circuitry and hence no one really knows the source of the defect in the first place. The repairman blames the manufacturer, the manufacturer blames the repairman and the customer doesn't know who to blame.

The magnitude of the problem is immense. One manufacturer in a local area assembles and releases over twenty thousand printed circuit boards per week and those boards, for the most part, are shipped out to the repairman for replacement purposes in the field or for shipment to further assembly plants, each PC board usually in an individual bag and box. Some may go into inventory at one place or another.

The impregnated plastic bag does safeguard the PC board against static charges of large voltage but it is expensive, it has a useful life of only about six handlings, and the bag does not safeguard the PC board against physical damage. Consequently the primary objects of the present invention are to devise a unique method for constructing a carbon black circumvallate for protecting printed circuit boards and other goods against the ravages of a discharge of static electricity, to expedite handling of a printed circuit board in a service operation, to make possible superior protection of printed circuit boards or other goods sensitive to a discharge of static electricity, to save cost compared to the plastic box impregnated with conductive carbon black particles, and to make possible a unique mode of inventorying and shipment of goods as will be described.

While the invention has been so far described from the standpoint of PC boards the invention is equally applicable to protecting expensive lenses because a static charge on the lens will attract and hold abrasive grit which when rubbed will scratch and ruin the lens.

IN THE DRAWING

FIG. 1 is a diagrammatic view of applying a carbon black dispersion to a planar surface of a paper board lamination;

FIG. 2 is a diagrammatic view of constructing a paper board lamination while employing a web already coated;

FIG. 3 is a diagrammatic view of construction partitioner board;

FIG. 4 is a fragmentary plan view of a scored and die cut carton blank ready to be separated from a lamination FIG. 5 is a fragmentary plan view of carton partitioner assembly blank ready for separation from the corresponding lamination FIGS. 6 and 7 are perspective views of cartons constructed in accordance with the present invention and modes of use;

FIG. 8 is a perspective view of a carton top;

Figure 9:
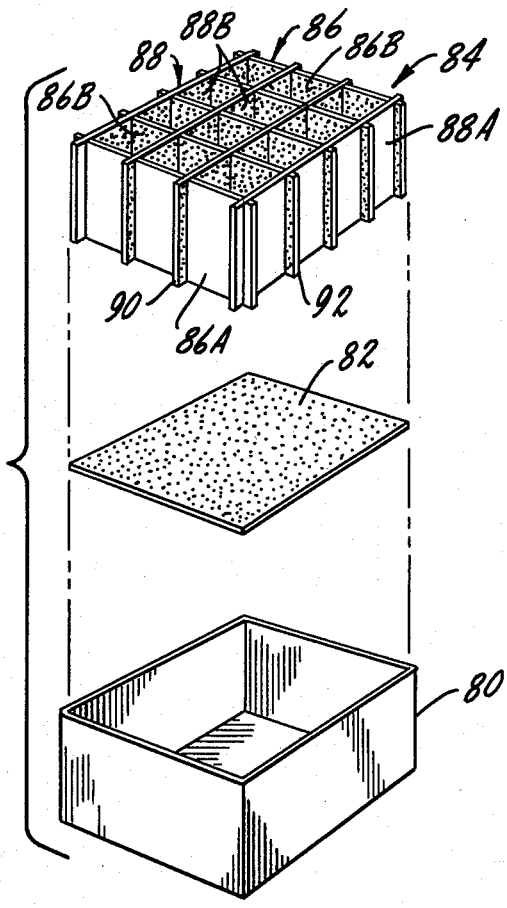
FIG. 9 is a perspective view of another embodiment

At the present time printed circuit boards for replacement are delivered to service points throughout the world. Each is placed in a carbon black-impregnated polyethylene bag; the bag is wrapped by packing material and then inserted in a box. Upon arrival at the destination, until used, the outer packing including the box and packing material are discarded, and the black bag containing the printed circuit board is placed on a shelf, in a service kit or otherwise carried around until installed as a replacement in the equipment. The defective printed circuit board is then inserted into the polyethylene (black) bag and taken back to the service department, repacked and sent back to the manufacturer.

Under the present invention an inexpensive but thoroughly effective circumvallate of carbon black on a sturdy support is so constructed as to afford a cavity in which may be inserted the PC board or other item sensitive to a discharge of static electricity. If there is a discharge from the outside of the cavity sufficiently high to penetrate the support, it encounters the carbon black circumvallate trap and circulates thereabout until dissipated; it never reaches the goods. Specifically, the carbon black trap is a coating of carbon black applied to a web of paper board laminated to at least one other paper board thickness so that the support may be erected from carton blanks separated from the lamination.

In one form of practice, the printed circuit board prior to insertion may be wrapped in a sheet of anti-static (electricity) plastic, such as polythylene "bubble wrap". The box or carton may have a label on one end designating the specific PC board and may contain a work order sheet which the repairman will fill out, showing the problems of the defective PC board he has replaced, and also a return mailing label. The box ordinarly will not be opened until the PC board therein is to be installed as a replacement for the defective PC board.

When the new PC board is installed, the old one will be wrapped in the same wrapping, inserted into the same box with the work order sheet filled out by the service man. The inner address label will be applied over the old label and the box is ready for return mailing to the manufacturer.

In another form of practice, the cartons may be trays stacked atop one another so that PC boards may be assembled without apprehension of being ruined by a static discharge.

In another form of practice carton partitioners may be separated from a paper board web coated on both sides with carbon black; the partitioner may be inserted in the carton or box aforesaid to afford numerous circumvallate cubicles for the goods inside one box, and the boxes stacked one atop another.

This system will reduce material costs, will give a stronger support than a mere bag, will simplify inventory, will eliminate man hours for handling and packaging, and will allow more carbon black to be used compared to the bag. These advantages constitute additional objects of the present invention.

The coating vehicle incorporating the carbon black may be composed of seventy pounds of water and thirty pounds of any preferred printing ink varnish containing twelve and one half pounds of dispersed conductive carbon black particles. This calculates out to one and one-quarter pounds of conductive carbon black per gallon. The coating may be roller coated or applied in any other convenient manner. A coating weight corresponding to one pound per one hundred square feet per pound (above formula) is capable of sustaining a charge of about fifty thousand volts per square inch.

The printing ink varnish is preferred as the principal vehicle for the carbon black particles because it represents an inexpensive, paper adherent, easily dried tacky (adhesive) material for effectively holding in dispersed form the carbon black particles. Any equivalent tacky vehicle may be used, that is, the varnish may be replaced by an acrylic or any other liquid vehicle employed in paper board printing inks capable of dispersing carbon black particles.

The coating, composed of water and the ink vehicle, is an emulsion of course and the conductive particle preference in VULCAN XC-72LR conductive carbon black particles supplied by Cabot Corporation: 98.5% by weight fixed carbon (1.5% volatiles), 19 millimicrons mean diameter, log volume resistivity (ohms-cm) in the range of about 2.3 to 6.

The assembly of the circumvallate of carbon black on a paper board support may be accomplished in different ways, starting with applying the conductive coating to a paper board planar surface in different ways. At this point it may be mentioned that to achieve the desired strength for protection the box for minimum strength in most instances will be either the grade known in the paper industry as E-flute corrugated board (double-faced) or the grade of board known as folding carton board. Under the present disclosure, the term paper board applies to either of the preferred grades.

Referring to FIG. 1, E-flute corrugated board 10, previously laminated, is advanced as a continuous web or strip between a pair of opposed rollers 12 and 14. The above specified conductive coating material (the carbon black dispersion) is supplied from a trough 16 and is fed by a set of fountain rollers, collectively identified as 18, to roller 12 which may be of the form and character used for applying printing ink. Thus, roller 12, of suitable nature, applies a uniform and continuous coating to the upper paper board sheet or web 20 and continuously, across a predetermined width. Alternatively, the lower sheet or web of paper board 22 may be continuously and uniformily covered in the same fashion. The two webs 20 and 22 are, of course, separated by the intermediate flute or corrugation 24.

In some instances it may be desirable to coat the paper board web separately and afterwards complete the lamination. This is shown in FIG. 2 where the web 20A has been earlier provided with the conductive coating and rewound on a supply roll 26 which is then shipped to the corrugator to complete a corrugated lamination 10A identical in all the respects to the coated lamination 10 shown in FIG. 1.

As will be explained hereinafter, the carton may be partitioned and in such event both sides of the lamination 10 shown in FIG. 1 will be coated in the fashion of FIG. 1 or, alternatively, the corrugated material from which the partitioners are to be separated may be constructed from pre-coated webs in the fashion of FIG. 2. This is shown in FIG. 3 where two paper board webs 32 and 34, each previously coated with conductive carbon black, are laminated to opposite sides of the medial paper board flute 36. It is to be understood, as noted above, that folding carton board of equivalent strength (two or more flat plys) may be used in place of corrugated.

As shown in FIG. 4, the laminated paper board stock material presents at least one outer planar surface entirely (except possibly for margins representing wastage) and uniformily coated with the dried carbon black coating which is to constitute the carbon black circumvallate. The dried coating is denoted by stipling in FIG. 4 and in FIGS. 5, 6 and 7 as well. After the coating has dried, the laminated stock material is scored along score lines as 38, slotted, as at 40 and is separated along cut lines 42 incidental to separating from the laminated web a carton blank of the desired configuration.

The carton blank shown in FIG. 4 is for illustrative purposes but also shows that the carton blank, from which the carton is to be erected, may have a pair of side panels 44, a pair of end panels 46 joined by score lines to the side panels, a pair of end flaps 48 joined by score lines to each of the end panels, and a pair of side flaps 50 joined by score lines to each of the side panels. All of the flaps are seperated by slots 40. The side panels define the length of L of the resultant carton and the end panels define the width W of the resultant carton. A joint tab 52 for a glued joint may be attached by a score line to an end panel.

The blank shown in FIG. 4 enables a six-sided carton to be erected and closed with all inside surfaces opposite outside surfaces presenting the desired carbon black circumvallate such that a printed circuit board inserted into the carton cavity before closure is within the carbon black circumvallate and any discharge of static electricity outside the container, even if it penetrates the thickness of the paper board, will be trapped by an inside carbon black circumvallate coating on one of the panels or flaps and will circulate endlessly thereabout, until finally bled off or dissipated.

A joint tab as 52 need not always be used and indeed the end closure flaps may be secured by a tape or they may be secured by a tuck-in flap. If a tuck-in flap is used the closable end wall may also include bend-over ears cooperating with the tuck-in flap to secure the contained goods. Especially in the instance of a printed circuit board or a lens it may be desirable to wrap either one before insertion.

Literally, there will be hundreds of thousands, if not millions, of printed circuit boards shipped to a point of distribution by any particular manufacturer in one year. Again, the chances for destruction of micro processing circuitry are literally endemic and this is particularly so from the standpoint of repeated handling, for purposes of inventory or shipment. I have therefore envisioned that both inventory and shipment may be facilitated under and in accordance with the present invention by affording carton partitioners which not only serve to segregate the goods in individual cubicles inside the container but also afford additional carbon black circumvallates. Thus, and referring to FIG. 6, a carton 60 produced in accordance with the present invention as described above may incorporate a partitioner 62 defining eight cells or cubicles inside the carton, each segregating an individual printed circuit board PCB. The partitioner may be cut and separated from the blank 64, FIG. 5, which has been coated on both sides with the conductive carbon black dispersion described above. The partitioner is of the usual form including a frame 66 and a corresponding number of stringers 68.

The carton shown in FIG. 6, partitioned, is a six-sided container in that there are closure flaps affording a closed top wall. However, particularly in the instance of a massive inventory or shipment, the cartons may be stacked one a-top another as shown in FIG. 7 in which event only the top-most container needs to be closed off. Thus, both to save money and to facilitate handling of the cartons themselves during insertion of the goods, it is advantageous to produce carton blanks which do not necessarily have end or side flaps since the goods contained in the lower-most carton as 70 FIG. 7 will be safeguarded by the carbon black circumvallate afforded on the inside surface of the bottom wall of the next top container 72. On the other hand, the upper most or top tier container 74, FIG. 7, will be topped off by a lid or cap 76, FIG. 8, the inside surface of which will be coated entirely and continuously with the above described carbon black dispersion. The lid 76 may be produced as a special item just as the partitioners may be produced separatly from laminated board, although the lid 76 need only be coated on the surface constituting the inside surface. Four three-high tiers of the kind shown in FIG. 7 may be conveniently assembled on a pallet, with the tops of the four top-most cartons each topped off by a lid as 76, each lid being taped or otherwise battened down, and the entire assembly strapped to the pallet for transportation.

The exact amount of carbon black in the coating emulsion is not critical. Five percent by weight should be deemed the minimu,; a concentration as high as 16.5% may be used.

A modification of the invention is shown in FIG. 9. Instead of erecting a paper board carton from coated stock material, an ordinary paper board carton 80 may be used which is afterwards lined and partitioned with paper board inserts which are coated to afford the carbon black circumvallate.

Thus as shown in FIG. 9 an existing paper board carton 80 of any selected, standard dimension may be lined on the bottom wall with a separate paper board liner 82 coated on the top side with carbon black as above described and specified, located on the bottom wall of the existing carton 80 with the carbon black (stippled) surface facing upwardly.

After the bottom liner has been positioned, a partitioner 84 may then be inserted into the container. The partitioner 84 is typically characterized by a plurality of intercepting (slot joint) frames and stringers 86 (five frames) and 88 (four stringers) so arranged as to present short stub ends 90 and 92 which serve as spacers as shown in FIG. 10 when they are engaged with the opposed walls of the paper board carton 80.

Figure 10:
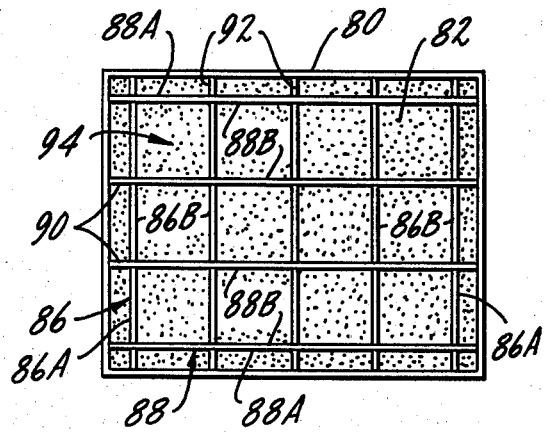
FIG. 10 is a top view of the FIG. 9 embodiment.

It is not necessary that the outside surfaces 86A and 88A of the frames and stringers of the partitioner 84 be coated with carbon black but it is necessary that the inside surfaces 86B and 88B be so coated (stippled) so that each cell 94, FIG. 10, will be defined by a five-sided carbon black circumvallate, taking into account that the bottom liner 82 defines the bottom wall of the cells.

Figure 11:
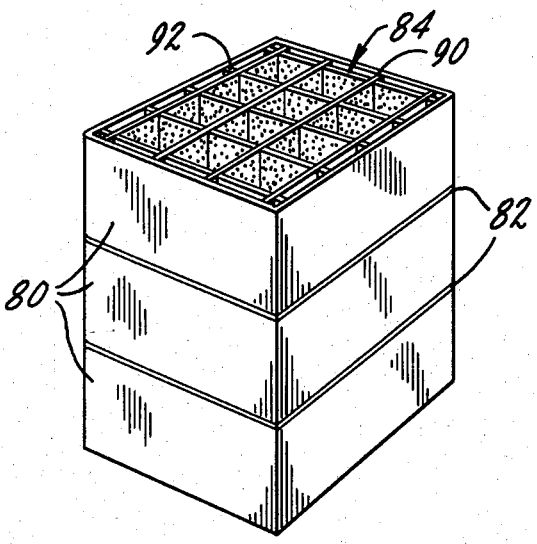
FIG. 11 is a perspective view of a stack of cartons of the FIG. 9 embodiment.

TRhe printed circuit boards susceptible to damage by static electricity may then be inserted into the individual cells 94 (twelve in number) and the top of the container may then be closed off by a second liner as 82, inverted so that the carbon black side faces downward to complete twelve six-sided circumvallates completely encapsulating the printed circuit boards inside the container 80. As shown in FIG. 11 the filled containers may be stacked one atop another for inventory or for shipment. If preferred, the top wall or lid may be in the form of a cap instead of a flat insert as 82.

Figure 12:
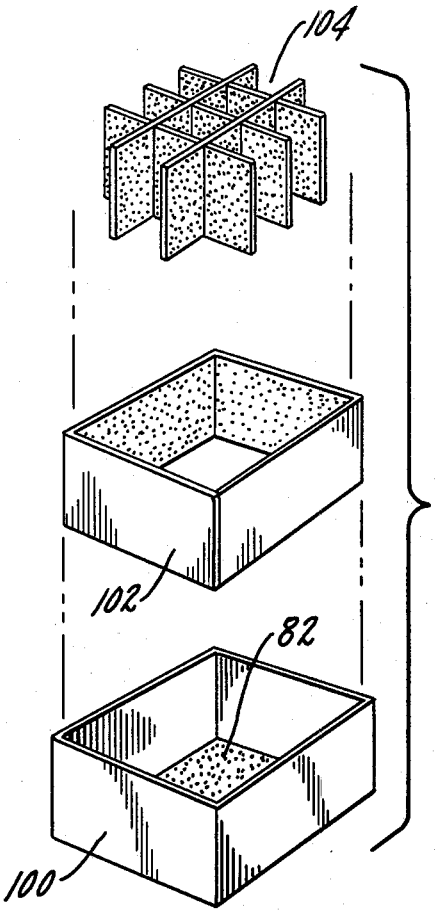
FIG. 12 is a perspective view of another embodiment.

FIG. 12 shows another inexpensive way in which the invention may be practiced without necessarily erecting the paper board container from stock material coated with carbon black. Thus, again, an existing plain paper board carton 100 may be lined on the bottom with a liner as 82, with the carbon black coated surface facing upwardly. Afterwards, a one-opiece liner 102, so folded that there are four sides corresponding to the two side walls and end walls of the box 100, may be inserted vertically into the box 100. As shown in FIG. 12, the liner 102 will be coated on the inside surfaces with carbon black designated by stippling. Next, a partitioner 104 having inter-fitted frames and stringers, coated on all facing surfaces with carbon black, will be positioned inside the liner 102 such that, in the embodiment shown in FIG. 12, there will also be twelve cells found inside the box each presenting a five-sided carbon black circumvallate which may be finally topped off by a closure lid coated on the underside with carbon black as above described.

I claim:

1. A method of affording an inexpensive but effective carbon black circumvallate trap for static electricity originating outside the trap so that goods inside the trap, which may be ruined by a discharge of static electricity, are protected by the carbon black circumvallate, said method comprising:

a. Coating a web of paper board on at least one planar surface, and continuously over an area bounded by a predetermined width and length, with a layer of carbon black deposited from a dispersion in liquid form and which does not and need not penetrate to the opposite surface, thereby to provide a web comprising said coated layer while leaving the interior of the web substantially devoid of the coating layer;

b. Scoring the web and separating therefrom a carton blank lying within said area, the separated edges of said blank bounding a continuous carbon black area;

c. Folding and erecting a carton from said separated blank so that said layer of carbon black is on all inside surfaces opposite outside surfaces of said carton thereby forming a carbon black circumvallate trap; and d. Inserting into such carton cavity circumvallate goods to be protected against the ravages of a discharge of static electricity occurring on an outside surface of the carton.

2. A method according to claim 1 which includes the steps of separating carton partitioners from paper board web coated on both surfaces in accordance with step (A); separating the partitioners; inserting a partitioner into the cavity of an erected carton; and inserting said goods into the partitioned carton.

3. A method according to claim 2 in which the carton has an open top at the time the goods are inserted and in which the open top of the carton is afterwards closed by a panel of paper board coated on the inside with carbon black.

4. A method according to claim 1 in which each erected carton has six sides, one side having one or more closure flaps.

5. A method of affording an inexpensive but effective carbon black circumvallate trap for static electricity originating outside the trap so that goods inside the trap, which may be ruined by a discharge of static electricity, are protected by the carbon black circumvallate, said method comprising:

A. coating a paper board box having at least five sides with carbon black deposited from a liquid dispersion as a layer on the bottom wall facing the interior of the box;

B. inserting into the box a partitioner means coated on all surfaces facing the inner side of the box with carbon black also deposited from a liquid dispersion as a layer thereon so that the partitioner means together with said carbon black bottom wall define at least one five-sided carbon black circumvallate cell into which said goods may be inserted, and the carbon black being confined to the coated surfaces of the bottom wall and partitioner means so that at least the interiors thereof are substantially devoid of such carbon black.

6. A method according to claim 5 in which said goods are packed into the circumvallate cell after which the cell is closed by a lid coated on its inside surface with carbon black.

7. An inexpensive but effective carbon black circumvallate trap for static electricity originating outside the trap so that goods inside the trap, which may be ruined by a discharge of static electricity, are protected by the carbon black circumvallate, said trap comprising: a paper board box having on the bottom wall a carbon black facing on the upper side facing the interior of the box, said carbon black facing being deposited as a layer from a liquid dispersion which need not and does not penetrate to the opposite side of the bottom wall so that at least the interior of the bottom wall is substantially devoid of such layer, a partitioner inserted into the box, said partitioner comprising at least two frames and at least two stringers each coated on opposed surfaces facing one another with carbon black also deposited as a layer from a liquid dispersion but with the interior of the frames stringers being substantially devoid of such layer so that the interior of the box is thereby divided into individual cells each having a circumvallate of carbon black.

8. A plurality of boxes according to claim 7 stacked one atop another for inventory or shipment with said goods packed in the cells.

9. A method according to claim 1 including the step of providing a partitioner on its opposed surfaces with carbon black deposited as a layer from a liquid dispersion of carbon black, which partitioner is substantially devoid of a carbon black layer in the interior, and positioning the partitioner edgewise vertically in the carbon black circumvallate cavity thereby to divide the cavity into individual cells for the goods to be protected.

10. A method according to claim 1 in which said carton containing goods is positioned atop an identical carton containing like goods so the carton on top guards goods in the carton beneath.

11. A method according to claim 5 in which a box into which the goods are inserted is positioned atop an identical box beneath into which like goods are inserted.

12. An inexpensive but effective carbon black circumvallate trap for static electricity originating outside the trap so that goods inside the trap, which may be ruined by a discharge of static electricity, are protected by the carbon black circumvallate, said trap comprising:

a paper board box having on the bottom wall and four side walls a carbon black facing layer deposited from a liquid dispersion on the side facing the interior of the box, a partitioner means inserted into the box, opposed surfaces of said partitioner means respectively facing one of said sides also being faced with a carbon black layer deposited from a liquid dispersion, the opposed surfaces of the partitioner means and each of said walls being characterized in that at least the interior thereof is not penetrated by the carbon black so deposited, so that the interior of the box is divided into individual cells each having at least a five-sided circumvallate of carbon black.

13. A plurality of boxes according to claim 12 stacked one atop another with said goods packed in the cells.

14. A method of affording an inexpensive but effective carbon black circumvallate trap for static electricity originating outside the trap so that goods inside the trap, which may be ruined by a discharge of static electricity, are protected by the carbon black circumvallate, said method comprising:

A. providing a paper board box having a bottom wall coated on its upper surface with a layer of carbon black and having four side walls each coated on the inner surface with a layer of carbon black, said carbon black layers being deposited from a liquid disperson;

B. inserting edgewise and upright into the box at least one partitioner coated on opposed surfaces with carbon black also deposited as a layer from a liquid dispersion, and each layer of carbon black on the bottom wall and on the side walls and on the partitioner being confined substantially to the surface to which it is applied so that the areas beneath are substantially devoid of the surface layer of carbon black whereby the partitioner together with said walls defines a plurality of five-sided carbon black circumvallate cells into which said goods may be inserted and then covered.

* * * * *